US011925245B2

(12) United States Patent
Seiders et al.

(10) Patent No.: US 11,925,245 B2
(45) **Date of Patent: *Mar. 12, 2024**

(54) BAG

(71) Applicant: YETI Coolers, LLC, Austin, TX (US)

(72) Inventors: Roy Joseph Seiders, Austin, TX (US); Erik Steven Larson, Austin, TX (US); Derek G. Sullivan, Austin, TX (US); Alex Baires, Austin, TX (US); Jeffrey Charles Munie, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,110

(22) Filed: Aug. 11, 2020

(65) Prior Publication Data

US 2020/0367620 A1 Nov. 26, 2020

Related U.S. Application Data

(63) Continuation of application No. 15/453,655, filed on Mar. 8, 2017, now Pat. No. 10,736,391, which is a (Continued)

(51) Int. Cl.
*A45C 5/08* (2006.01)
*A45C 7/00* (2006.01)
(Continued)

(52) U.S. Cl.
CPC ..... *A45C 5/08* (2013.01); *A45C 7/0059* (2013.01); *A45C 9/00* (2013.01); *A45F 3/02* (2013.01); *A45F 3/04* (2013.01); *A45C 2009/007* (2013.01)

(58) Field of Classification Search
CPC ..... A45C 5/08; A45C 7/0059; A45F 3/02
(Continued)

(56) References Cited

U.S. PATENT DOCUMENTS 2,210,351 A * 8/1940 Westendorf ..... A45C 3/00 190/119
2,228,066 A 1/1941 Tashbook
(Continued)

FOREIGN PATENT DOCUMENTS

CA 2300014 A1 8/2001
CA 2327764 A1 6/2002
(Continued)

OTHER PUBLICATIONS

Amazon, "Seattle Sports FrostPak Soft Cooler", First reviewed Jun. 17, 2014, Accessed Jan. 31, 2016. (https://www.amazon.com/Seattle-Sports-FrostPak-Soft-Cooler/dp/BOOLGZ28FI).
(Continued)

*Primary Examiner* — Scott T McNurlen
*Assistant Examiner* — Lester L Vanterpool
(74) *Attorney, Agent, or Firm* — Banner & Witcoff, Ltd.

(57) ABSTRACT

An example bag may include an outer shell comprising a front panel, a rear panel, a top sidewall, a bottom sidewall, a first sidewall, a second sidewall forming, and a closure configured to move from an open position to a closed position. The bag may also include a pair of adjustable straps. The adjustable straps can be configured to move from a first backpack carry position to a second hand carry position by releasing the adjustable straps from the outer shell of the bag from the first carry position and securing the adjustable straps to the second carry position.

20 Claims, 8 Drawing Sheets

Related U.S. Application Data continuation-in-part of application No. 29/580,469, filed on Oct. 10, 2016, now Pat. No. Des. 808,225, and a continuation-in-part of application No. 29/580,477, filed on Oct. 10, 2016, now Pat. No. Des. 825,276, and a continuation-in-part of application No. 29/580,480, filed on Oct. 10, 2016, now Pat. No. Des. 808,172, and a continuation-in-part of application No. 29/580,484, filed on Oct. 10, 2016, now Pat. No. Des. 808,173, and a continuation-in-part of application No. 29/580,485, filed on Oct. 10, 2016, now Pat. No. Des. 808,174, and a continuation-in-part of application No. 29/580,487, filed on Oct. 10, 2016, now Pat. No. Des. 808,175.

(51) Int. Cl.
*A45C 9/00* (2006.01)
*A45F 3/02* (2006.01)
*A45F 3/04* (2006.01)

(58) Field of Classification Search
USPC ..... 224/578, 579, 580, 153; 190/113, 115
See application file for complete search history.

(56) References Cited

U.S. PATENT DOCUMENTS 3,019,952 A * 2/1962 Brewster ..... A45F 3/04 294/142
3,254,816 A 6/1966 Gray
3,802,613 A * 4/1974 Droeger ..... A45F 3/04 224/153
RE30,138 E * 11/1979 Cowen, III ..... A63B 60/58 223/74
4,210,186 A * 7/1980 Belenson ..... A45C 3/00 190/110
4,273,274 A * 6/1981 Freistadt ..... A45F 3/04 150/108
4,334,601 A * 6/1982 Davis ..... A45C 3/00 190/111
D269,738 S 7/1983 Stark
D281,649 S 12/1985 Bomes et al.
D284,425 S 7/1986 Allen
4,805,748 A 2/1989 Gerch
4,830,154 A 5/1989 Gerch et al.
D304,264 S 10/1989 Peregrine et al.
D307,668 S 5/1990 Young
5,005,679 A * 4/1991 Hjelle ..... A45C 3/00 150/106
5,007,250 A 4/1991 Musielak
5,105,919 A * 4/1992 Bomes ..... A45C 5/14 190/111
D328,389 S 8/1992 Pardo
5,140,833 A 8/1992 Whalen
5,377,887 A * 1/1995 Garcia ..... A45F 3/04 224/580
5,415,332 A 5/1995 Kliot
5,577,652 A * 11/1996 Cooper ..... A45F 3/02 224/153
5,671,698 A 9/1997 Farrugia
5,927,581 A 7/1999 Reddy et al.
5,931,120 A 8/1999 Burns et al.
6,092,661 A 7/2000 Mogil
D434,900 S 12/2000 Spence, Jr. et al.
6,286,461 B1 * 9/2001 Martz ..... A01K 1/0254 119/497
6,338,180 B1 1/2002 Massard
6,390,345 B1 * 5/2002 Brown ..... A45C 3/00 190/110
6,409,066 B1 6/2002 Schneider et al.
6,460,746 B1 10/2002 Amram
D465,924 S 11/2002 Gisser
D468,533 S * 1/2003 MacRae ..... D3/286
6,601,743 B2 8/2003 Godshaw
6,619,447 B1 * 9/2003 Garcia, III ..... A45C 7/0086 190/110
D481,540 S 11/2003 Van Himbeeck
D495,489 S 9/2004 Messina-Brown
6,793,112 B2 9/2004 Ammerman
D509,959 S * 9/2005 Nykoluk ..... D3/289
D516,307 S 3/2006 Koenig et al.
D528,792 S 9/2006 Marttila
D535,820 S 1/2007 Kamiya
7,160,028 B1 * 1/2007 Linday ..... A45C 9/00 150/108
7,207,426 B2 4/2007 Godshaw et al.
D548,966 S 8/2007 Aliberti et al.
7,334,684 B1 2/2008 Fontanilla et al.
7,344,028 B2 3/2008 Hanson
D569,610 S 5/2008 Wang
D575,059 S 8/2008 Cappiello et al.
7,597,478 B2 * 10/2009 Pruchnicki ..... A45C 13/02 383/110
D609,466 S * 2/2010 Stulman ..... D3/232
D620,708 S 8/2010 Sanz
7,861,857 B2 1/2011 Vorderkunz
D632,888 S 2/2011 Jobert
D648,533 S 11/2011 Sosnovsky
D661,085 S 6/2012 Custer
D667,043 S 9/2012 Couch, III
D667,219 S 9/2012 Munson
D674,603 S 1/2013 Gerbi
8,453,899 B1 6/2013 Calkin
D688,457 S 8/2013 Harris
D688,458 S 8/2013 Harris
D689,283 S 9/2013 Berkowitz
D692,662 S 11/2013 Pignotti
D698,150 S 1/2014 Sabounjian
8,695,770 B2 4/2014 Santy
D713,639 S 9/2014 Whitlock et al.
D717,040 S 11/2014 Swartzel et al.
D725,903 S 4/2015 Kuster et al.
D727,017 S 4/2015 Aberg et al.
D732,824 S 6/2015 Tzortzis
D738,107 S 9/2015 Adler et al.
D738,108 S 9/2015 Adler et al.
9,138,036 B2 9/2015 Andreasson et al.
D740,550 S 10/2015 Shabou
D740,551 S 10/2015 Shabou
D740,552 S 10/2015 Shabou
D742,646 S 11/2015 Amago
D745,778 S 12/2015 Shabou
9,215,918 B2 12/2015 Kao et al.
D747,873 S 1/2016 Peng
D749,318 S 2/2016 LoNigro
D758,075 S 6/2016 Quarry et al.
D761,562 S 7/2016 Venturini Fendi
D766,571 S 9/2016 Boroski
D770,761 S 11/2016 Deioma et al.
D777,425 S 1/2017 Shin et al.
D782,820 S 4/2017 Thompson
D784,908 S 4/2017 Kalchuri et al.
D785,325 S 5/2017 Samrelius et al.
D789,682 S 6/2017 Maeng
D792,167 S 7/2017 Bradley
D794,323 S 8/2017 Dumas
D794,947 S 8/2017 Gavriel et al.
9,730,499 B2 * 8/2017 Ford ..... A45C 9/00
9,737,122 B1 8/2017 Ives et al.
D802,298 S 11/2017 Sassi
D805,851 S 12/2017 Sullivan et al.
D808,172 S 1/2018 Seiders et al.
D808,173 S 1/2018 Seiders et al.
D808,174 S 1/2018 Seiders et al.
D808,175 S 1/2018 Seiders et al.
D808,225 S 1/2018 Seiders et al.
D810,435 S 2/2018 Hoppe et al.
D811,738 S 3/2018 Dumas
D811,746 S 3/2018 Seiders et al.
D812,898 S 3/2018 Lai
D813,539 S 3/2018 Van Assche

(56) References Cited

U.S. PATENT DOCUMENTS

| | | | | |
|---|---|---|---|---|
| D817,107 | S | 5/2018 | Larson et al. | |
| D819,327 | S | 6/2018 | Jusic | |
| D822,987 | S | 7/2018 | Seiders et al. | |
| D822,997 | S | 7/2018 | Seiders et al. | |
| D822,999 | S | 7/2018 | Seiders et al. | |
| D823,602 | S | 7/2018 | Seiders et al. | |
| D825,276 | S | 8/2018 | Seiders et al. | |
| 10,051,945 | B1 * | 8/2018 | Pomare | A45F 3/02 |
| D834,895 | S | 12/2018 | Triska et al. | |
| D840,687 | S | 2/2019 | Seiders et al. | |
| D840,689 | S | 2/2019 | Seiders et al. | |
| D844,975 | S | 4/2019 | Munie et al. | |
| D844,992 | S | 4/2019 | Seiders et al. | |
| D848,798 | S | 5/2019 | Munie et al. | |
| D851,400 | S | 6/2019 | Seiders et al. | |
| D853,115 | S | 7/2019 | Seiders et al. | |
| D854,312 | S | 7/2019 | Seiders et al. | |
| D854,322 | S | 7/2019 | Seiders et al. | |
| 10,384,855 | B2 * | 8/2019 | Seiders | A45C 3/00 |
| D867,823 | S | 11/2019 | Jacobsen | |
| D868,544 | S | 12/2019 | Lin et al. | |
| 10,544,976 | B2 | 1/2020 | Triska et al. | |
| D885,752 | S | 6/2020 | Dumas | |
| D890,517 | S | 7/2020 | Smith | |
| 10,781,028 | B2 | 9/2020 | Munie et al. | |
| D902,664 | S | 11/2020 | Munie et al. | |
| 10,827,808 | B2 * | 11/2020 | Seiders | A45C 13/008 |
| D918,666 | S | 5/2021 | Munie et al. | |
| D953,815 | S | 6/2022 | Wang | |
| 2003/0057239 | A1 * | 3/2003 | Godshaw | A45C 9/00 224/153 |
| 2003/0205601 | A1 | 11/2003 | Kilduff | |
| 2005/0263432 | A1 | 12/2005 | Hanson | |
| 2006/0065500 | A1 | 3/2006 | Herrig | |
| 2008/0142558 | A1 | 6/2008 | Dexter | |
| 2010/0284631 | A1 * | 11/2010 | Lee | A45C 3/06 224/642 |
| 2012/0006640 | A1 | 1/2012 | Santy | |
| 2013/0256173 | A1 * | 10/2013 | Sabbah | A45C 13/08 206/457 |
| 2013/0322786 | A1 * | 12/2013 | Nassanian | A45C 3/001 383/103 |
| 2014/0248003 | A1 | 9/2014 | Mogil et al. | |
| 2014/0254956 | A1 * | 9/2014 | Buell, III | A45F 3/04 383/88 |
| 2014/0270591 | A1 | 9/2014 | Joly | |
| 2015/0078684 | A1 * | 3/2015 | Koesters | B65D 31/08 383/114 |
| 2015/0367502 | A1 * | 12/2015 | Hassler | B25H 3/00 206/349 |
| 2016/0206061 | A1 | 7/2016 | Ford | |
| 2016/0278491 | A1 | 9/2016 | Amago | |
| 2017/0036844 | A1 * | 2/2017 | Seiders | A45C 11/20 |
| 2018/0000986 | A1 | 4/2018 | Seiders et al. | |
| 2018/0098607 | A1 | 4/2018 | Seiders et al. | |

FOREIGN PATENT DOCUMENTS

| | | |
|---|---|---|
| CA | 150323 | 12/2013 |
| CA | 150461 | 12/2013 |
| CN | 302623928 | 11/2013 |
| CN | 302852751 | 6/2014 |
| CN | 302946709 | 9/2014 |
| CN | 303092550 | 2/2015 |
| CN | 303620433 | 3/2016 |
| EM | 002307702-0003 | 9/2013 |
| EM | 002333591-0015 | 10/2013 |
| EM | 002348797-0001 | 11/2013 |
| EM | 002309591-0001 | 12/2013 |
| EM | 002309591-0002 | 12/2013 |
| EM | 002309591-0003 | 12/2013 |
| EM | 002309591-0005 | 12/2013 |
| EM | 002309591-0006 | 12/2013 |
| EM | 002309591-0007 | 12/2013 |
| EM | 002309591-0008 | 12/2013 |
| EM | 002309591-0009 | 12/2013 |
| EM | 002520213-0005 | 8/2014 |
| EM | 002599944-0001 | 1/2015 |
| EM | 002629964-0001 | 2/2015 |
| EM | 002119362-0001 | 4/2015 |
| EM | 002639724-0002 | 5/2015 |
| EM | 002734988-0003 | 7/2015 |
| EM | 002734988-0004 | 7/2015 |
| EM | 002760678-0005 | 9/2015 |
| EM | 002906594-0010 | 12/2015 |
| EM | 003146869-0001 | 8/2016 |
| EM | 003359199-0001 | 9/2016 |
| EM | 003359199-0002 | 9/2016 |
| GB | 4041233 | 8/2015 |
| JP | D1475659 | 7/2013 |
| KR | 300687326.0000 | 4/2013 |
| WO | D079659-001 | 12/2012 |

OTHER PUBLICATIONS

Kuiu, "TAKU 3000", Accessed May 10, 2017. (http://www.kuiu.com/gear-bags/taku-3000/96004.html ).

Amazon, "Seattle Sports Seattle Sports Downstream Duffel", First reviewed Oct. 26, 2009. Accessed Sep. 27, 2017.(https://www.amazon.com/Seattle-Sports-FrostPak-Soft-Cooler/dp/BOOLGZ28FI).

Seattle Sports, "Wet/Dry Toploader Duffel", Accessed Sep. 27, 2017. (http://www.seattlesportsco.com/custom-gear/wetdry-toploader-duffel. html).

Rei, "Patagonia Black Hole Duffel—60L", First reviewed "two years ago". (https://www.rei.com/product/884915/patagonia-black-hole-duffel-601) (Year: 2016).

Gear Junkie, "YETI Enters New Market: Meet the 'Panga' Submersible Duffel", Posted on Jun. 29, 2017. (http://gearjunkie.com/yeti-panga-submersible-duffel-review) (Year: 2017).

Amazon, "Säk Gear DuffelS?k Pro Waterproof Duffel Bag", First reviewed Jun. 20, 2018. (https://www.amazon.com/dp/B07D1GVCC4/) (Year: 2018).

Amazon, "Velomacchi Waterproof Hybrid Duffle Bag Backpack 50 Liter", First reviewed Jun. 3, 2018. (http://www.amazon.com/Velomacchi-Waterproof-Hybrid-Duffle-Backpack/dp/B07573PY96) (Year: 2018).

Amazon, "Bago Field Duffel Bag/Backpack/ Travel Tactical Duffle For Army Camping", First on sale Nov. 7, 2016. (https://www.amazon.com/dp/B01M6CSF2R) (Year: 2016).

Pelican "Dayventure Sling Cooler", First reviewed Oct. 30, 2019. (https://www.pelican.com/us/en/product/coolers/sling-cooler/dayventure/csling) (Year: 2019).

* cited by examiner

BAG

This application is a continuation application of U.S. Ser. No. 15/453,655, filed Mar. 8, 2017 which is a continuation-in-part of U.S. application Ser. Nos. 29/580,469, 29/580,477, 29/580,480, 29/580,484, 29/580,485, and 29/580,487 all filed on Oct. 10, 2016. All of the above applications are incorporated fully herein by reference.

FIELD

The present disclosure relates generally to a soft bag or luggage piece, for example a duffle-style bag.

1.0 BACKGROUND

Soft bags or duffle-style bags can be formed of soft fabric-like materials on each side to form an enclosure for storing various items. Certain example, duffle bags can have rectangular shapes, and can have a length that is longer than their width. Also a central opening can be provided along the bag's length. In certain examples, duffle bags may be used when traveling, during various outdoor activities, such as camping, fishing, hiking, etc. and can be, for example, carried on the user's shoulder or otherwise carried by hand through the use of various straps and/or handles to facilitate mobility.

2.0 SUMMARY

This Summary provides an introduction to some general concepts relating to this invention in a simplified form that are further described below in the Detailed Description. This Summary is not intended to identify key features or essential features of the invention.

Moreover, certain example bags may include an outer shell comprising a front panel, a rear panel, a top sidewall, a bottom sidewall, a first sidewall, and a second sidewall. The example bag may include a closure configured to move from an open position to a closed position and, in certain examples, may be an airtight, water resistant, or waterproof closure. The example bag may also include adjustable straps that may be configured to move from a first carry position to a second carry position by releasing the adjustable straps from the outer shell of the bag from the first carry position and securing the adjustable straps to the second carry position. In other examples, the bag may include one or more of a waterproof outer shell or a waterproof storage compartment.

3.0 BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

4.0 DETAILED DESCRIPTION

Figure 1:
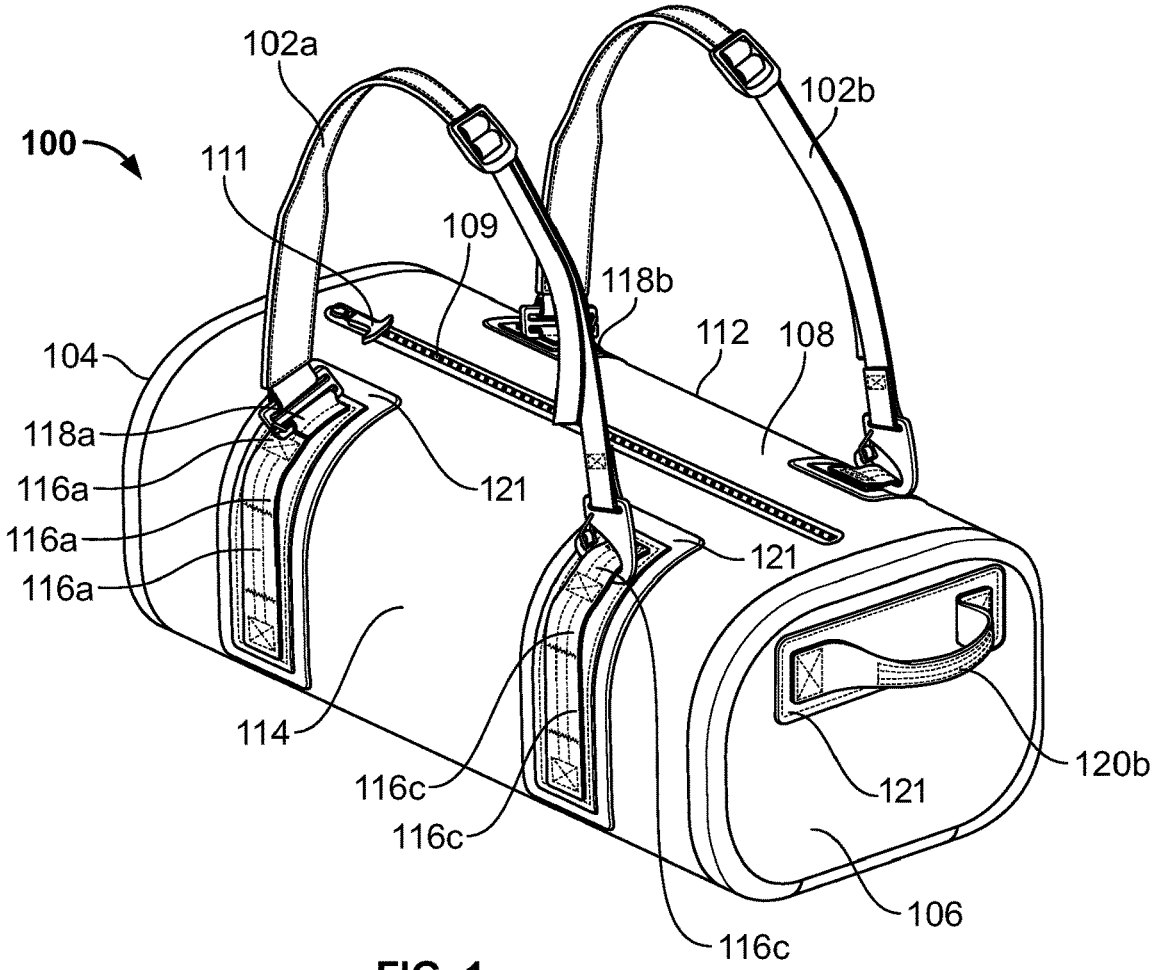
FIG. 1 shows a left rear perspective view of an example bag in accordance with an aspect of the disclosure.

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

FIGS. 1-8 generally depict an exemplary bag 100 that can be configured to store various contents. The bag 100 can include a soft-sided structure and can generally represent a cuboid or rectangular prism with rounded corners, cylinder, oblong cylinder, or elliptical cylinder. The exemplary bag can include a front pane 1104 and a rear panel 106, a top sidewall 108, a bottom sidewall 110, a right sidewall 112, and a left sidewall 114, which form an outer shell of the example bag 100. The example bag 100 may also include a closure 109, which extends along the length of the bag 100. As discussed below, the outer shell and the closure 109 can be water proof or water resistant to form a sealed compartment within the bag 100. Also the bag 100 may be formed air tight and can be configured to be submersible under water, while keeping the stored contents dry or substantially dry. In one example, the bag can be configured to be submersible for a period of up to 30 minutes or greater than 30 minutes while maintaining the contents of the bag completely dry.

Figure 1B:
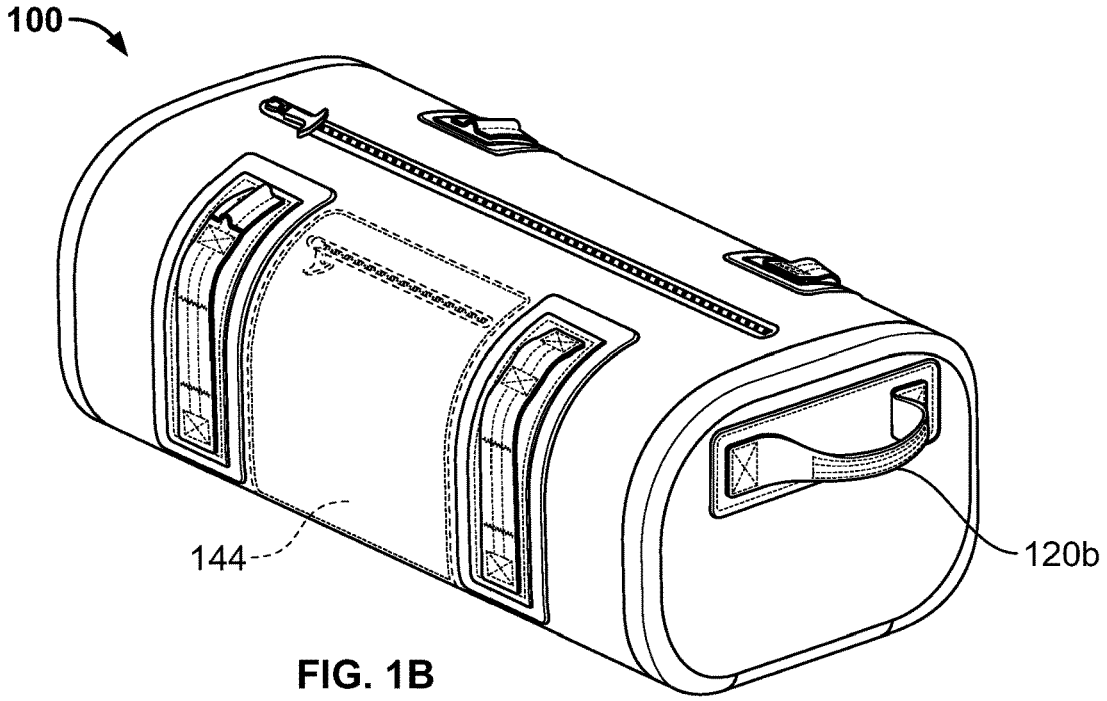
FIG. 1B shows a semi-transparent perspective view of an inside area of the example bag of FIG. 1.

The example bag 100 can include two adjustable carry straps 102*a*, 102*b*, a top or first side handle 120*a*, and a bottom or second side handle 120*b* for carrying the example bag 100. Straps 102*a*, 102*b* can, in one example, be identically formed straps, which include the same or identical features and components. The example bag 100 can also include a series of loops 116*a*, 116*b*, 116*c*, 116*d* that are located on and extend from the top sidewall 108 to the right sidewall 112 or the left sidewall 114. Additionally the bag 100 can include upper ring loops 118*a*, 118*b* for holding the upper portions 122 of the carry straps 102*a*, 102*b* therein. Moreover, as shown in FIG. 1B, which is a partially transparent perspective view illustrating the inside surface of the bag 100, one or more internal pockets 144 may also be included inside the bag 100 for a compartmentalized storage of various items. Also, although not shown, the bag may also include an inner liner that forms an inner compartment for receiving contents in the bag 100. Together the inner liner and the outer shell can form an air tight and water proof/water resistant structure.

In one example, the closure 109 can be substantially waterproof or form a barrier to prevent liquid contents from either entering or exiting the bag. Additionally, the closure 109 can be impervious to liquid such that the liquid penetration into the closure 109 is prevented at any orientation of the bag 100. The closure 109 may also be constructed such that it is airtight. Also maintaining the closure 109 in flat plane can assist in providing a water tight seal. In one example, the closure 109 can be a waterproof zipper assembly and can be watertight up to 7 psi above atmospheric pressure during testing with compressed air. However, in other examples, the water tightness of the closure 109 can be from 5 psi to 9 psi above atmospheric pressure and in other examples, the water tightness of the closure 109 can be from 2 psi to 14 psi above atmospheric pressure. The waterproof zipper assembly can include a slider body and pull-tab 111. In one particular example, the waterproof zipper assembly can be constructed with plastic or other non-metallic teeth to prevent injury when retrieving contents from the inner chamber. Suitable example closure mechanisms are disclosed in U.S. application Ser. No. 15/261,407 filed on Sep. 9, 2016, which is fully incorporated by reference herein for any non-limiting purposes.

In certain examples, the front panel 104, the rear panel 106, and the bottom sidewall 110 can be formed thicker than the top sidewall 108, the right sidewall 112, and the left sidewall 114. This provides additional reinforcement in those sections to provide support for the contents stored in the bag. However, each of these sections can be formed of similar materials. In one example, the top sidewall 108, the right sidewall 112, and the left sidewall 114, the top sidewall 108, the right sidewall 112, and the left sidewall 114 can all be formed of a TPU coated nylon fabric. In one example, a nylon fabric can be used as a base material for these portions of the bag and can be coated with a TPU laminate on each side of the fabric. In one example, the TPU nylon fabric used can be 0.6 millimeters thick and can be waterproof. However, it is contemplated that the fabrics used to construct the bag 100 incorporate antimicrobial materials to create a mildew-free environment. In one specific example, the nylon can be 840d nylon with TPU. Alternative materials used to manufacture the structure of the bag can be PVC, TPU coated nylon, coated fabrics, and other weldable and waterproof fabrics.

In certain examples, the materials forming outer shell of the bag including the top sidewall 108, the right sidewall 112, and the left sidewall 114 can be formed waterproof or water resistant. Also in certain examples, the front panel 104, the rear panel 106, and the bottom sidewall 110 can be provided with a rigid plate or panel to support those sections of the bag 100. For example, the rigid plate or panel could be formed of a suitable polymer or plastic, such as polyethylene. However, any stiffener material that is flexible could be used and other examples, may include a thermoformed PE, a TPU injection molded custom component. The components of the bag 100 including the top sidewall 108, the right sidewall 112, the left sidewall 114, the front panel 104, the rear panel 106, and the bottom sidewall 110 can be secured together by stitching, adhesive, polymer welding, and other suitable attachment methods.

Figure 6A:
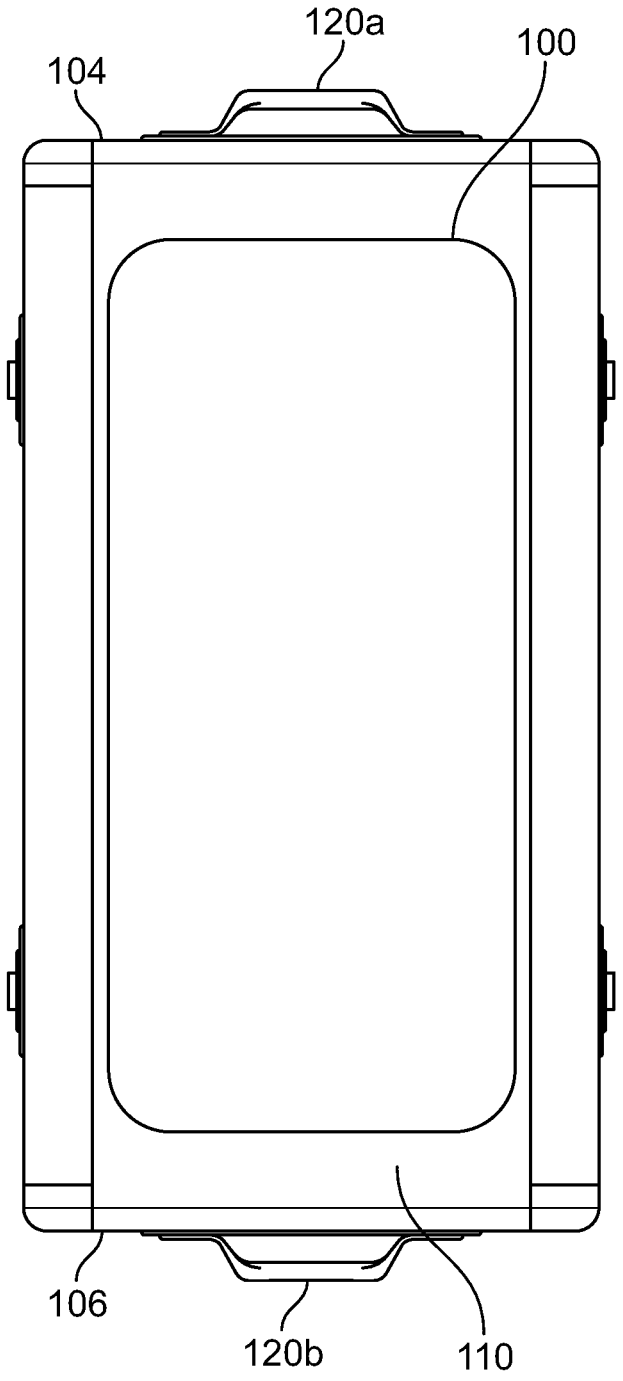
FIG. 6A shows a bottom view of the example bag of FIG. 1.
Figure 6B:
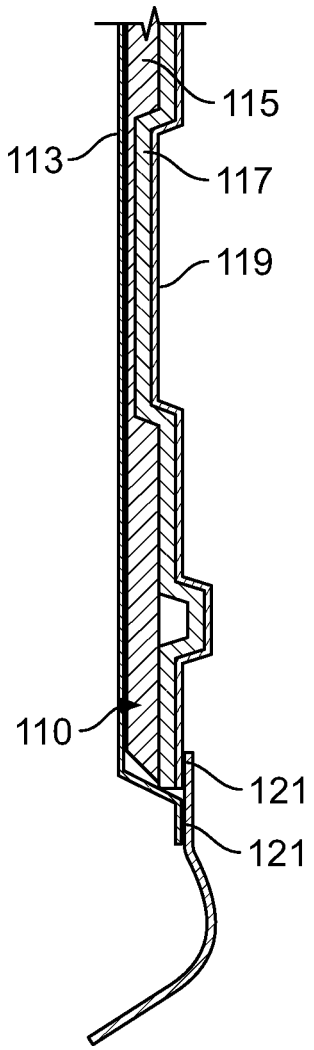
FIG. 6B shows a partial cross-section of an example bottom layer of the bag of FIG. 1.

Referring now in particular to FIGS. 6A and 6B, which respectively illustrate a bottom view of the bag 100 and a partial cross-section of the bottom layer of the bag 100. As shown in FIG. 6B, the bottom sidewall 110 can be formed of several layers of materials. For instance, the bottom sidewall 110 may be an EVA compression molded bottom and may include an additional structural layer 115, which can be formed of a foam material, such as a polyethylene foam, EVA foam or other suitable soft foam, an inner liner 113, which can be formed of a TPU coated nylon or other suitable fabric, and an outer layer 119, which can be formed of a TPU coated nylon, or other suitable fabric. Moreover, an additional layer 117, which is also formed of a foam material, such as a polyethylene foam, EVA foam or other suitable soft foam, can be formed between the padding layer 115 and the outer layer 119. The bottom sidewall 110 can be secured to the front and rear sidewalls 104, 106 by wrapping the fabric of the front or rear sidewalls 104, 106, or the fabric of the right or left sidewalls 112, 114 over sections of the outer layer 119.

Also, in certain examples, a similar layered structure as is shown in FIG. 6B may be implemented in the front and rear sidewalls or endcaps 104, 106 to provide for a more rigid structure such that the bag 100 maintains its general shape during its use. The additional structure and padding in these areas, e.g. the bottom and sides of the bag 100, helps to provide additional protection and durability to the bag to prevent rips, tears and scraps in the bag. It is also contemplated that padding layers such as foam can be provided in the regions of the bag 100 that contact the user's back and shoulders during carrying the bag 100 as a backpack to provide comfort to the user during carrying of the bag 100.

Figure 7A:
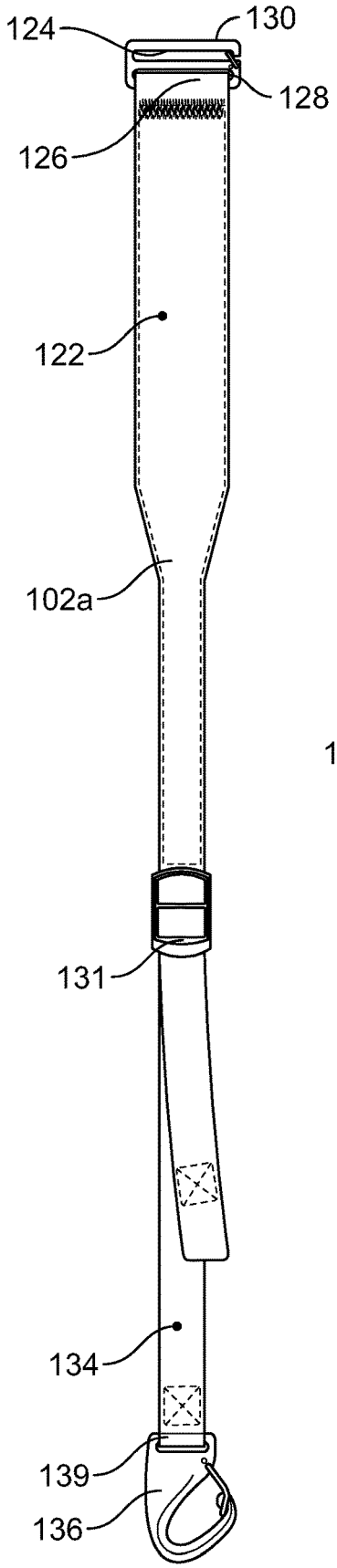
FIG. 7A shows a top view of an example strap.
Figure 7C:
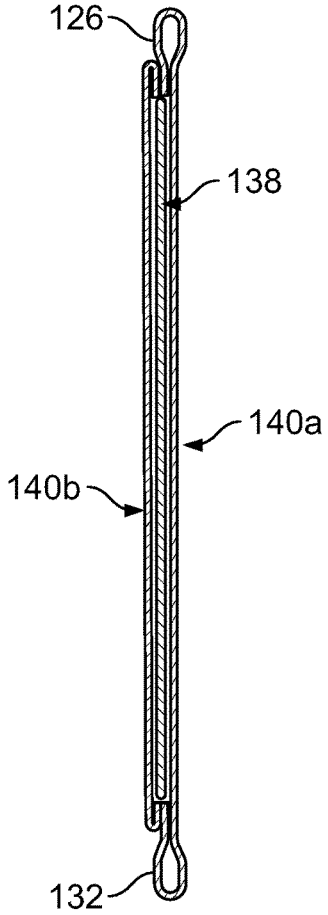
FIG. 7C shows a cross-sectional view of the example strap of FIG. 7A.
Figure 7B:
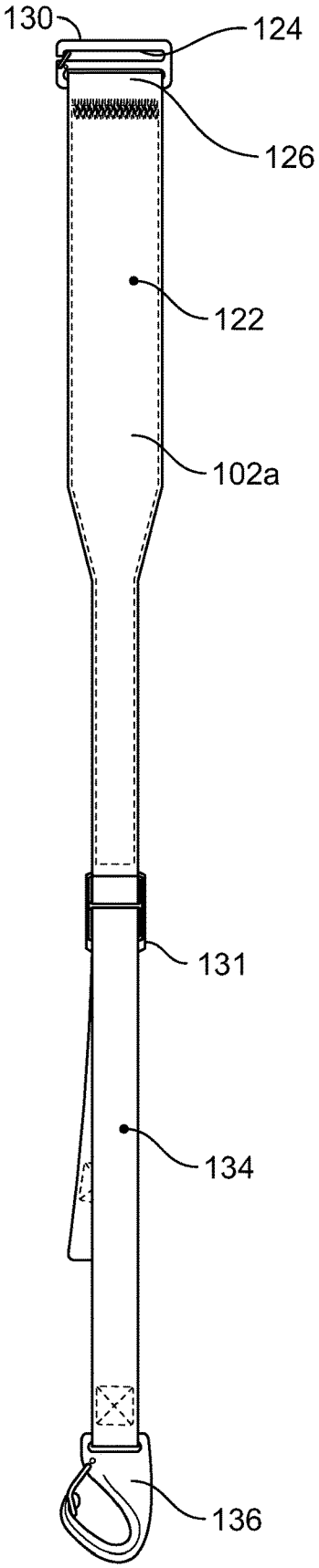
FIG. 7B shows a bottom view of the example strap of FIG. 7A.

FIGS. 7A, 7B, and 7C depict an exemplary strap 102*a*, 102*b* that can be used in conjunction with the example bag 100. FIG. 7A is a top view, and FIG. 7B is a bottom view of an example strap. FIG. 7C shows a cross sectional view of the upper portion 122 of the example strap 102*a*, 102*b*.

Starting with the upper portion 122 of the example strap 102*a*, 102*b*, a slide or ring 124 can be included at the upper portion 122 of the example strap 102*a*, 102*b* for securing the strap 102*a*, 102*b* to the upper ring loop 118*a*, 118*b*. In one example, the upper portion 122 can be sewn into an upper loop 126 around a lower loop 128 of the slide or ring 124, and the upper portion 130 of the slide or ring 124 can include an open end for securing the slide or ring 124 to the bag 100 at the upper ring loop 118*a*, 118*b*. The open end of the upper portion 130 of the slide or ring 124 allows for the strap to be adjustable on the bag 100. In certain examples, the upper portion 130 can be provided with a degree of elasticity or flexibility to allow for the ring 124 to flexingly engage the upper ring loop 118, 118*b* of the bag 100 such that the ring 124 is releasably secured to the upper ring loop 118, 118*b* of the bag. However, it is also contemplated that the ring 124 can include various clip arrangements such as a spring loaded clip in order to be adjustable on the bag. Also as shown in FIG. 7C, the upper portion 122 of the strap 102*a*, 102*b* can be formed with padding 138, which forms the shoulder region of the strap 102*a*, 102*b*. In one example, the padding 138 can be formed of a foam material, such as polyethylene foam, and the padding 138 can be sandwiched between two outside layers 140*a*, 140*b*.

The strap 102*a* may also include a strap adjuster 131 which is configured to adjust the length of the strap. The upper portion 122 of the strap 102*a* can be sewn into a lower loop 132 around the strap adjuster 131. The lower portion 134 of the strap 102*a* can include additional length that can be looped through the bottom section of the strap adjuster 131.

The end of the lower portion 134 of the strap 102*a* may also be sewn into a loop 139 around a spring clip 136. As will be discussed below, the spring clip 136 is configured to be depressed by the user to move the strap in the lower loops 116*c*, 116*d* to accommodate different carry arrangements of the straps 102*a*, 102*b*.

Figure 2:
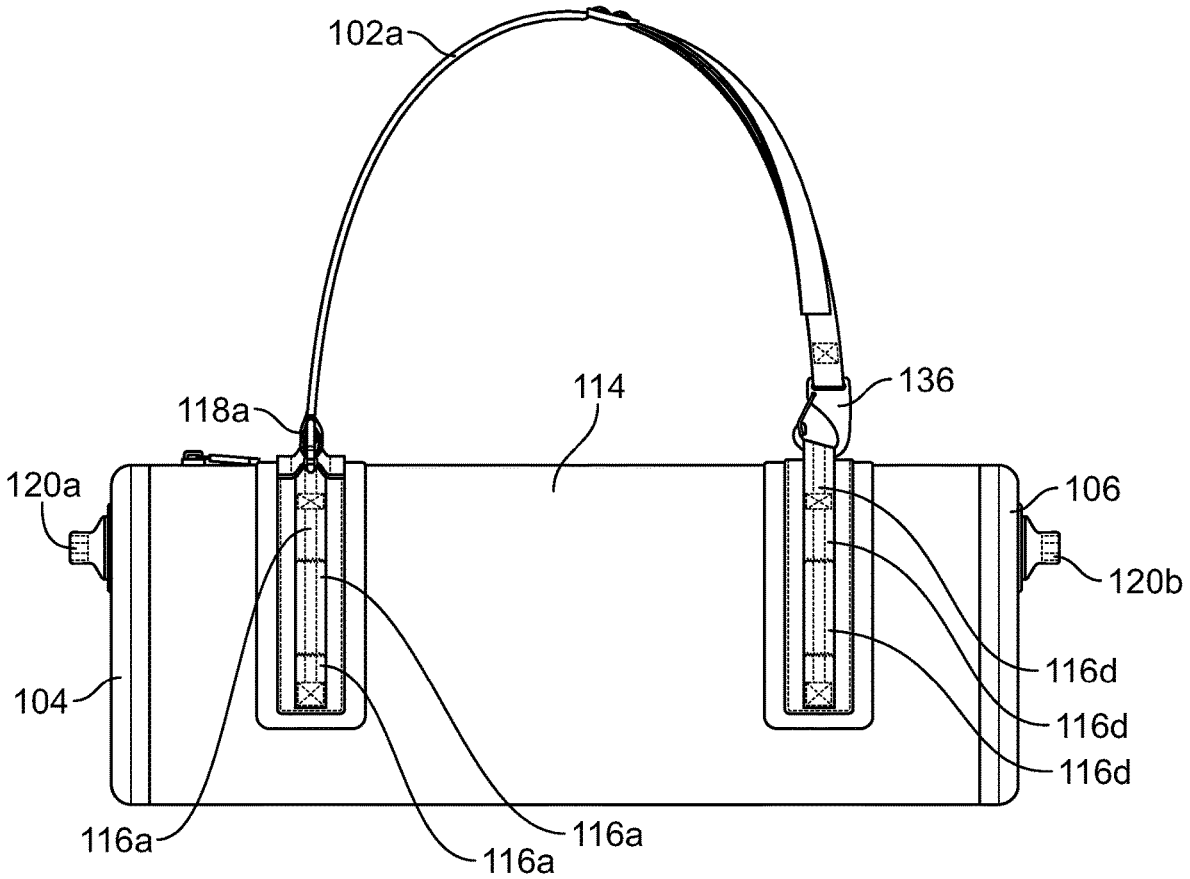
FIG. 2 shows a left side view of the example bag of FIG. 1.
Figure 2A:
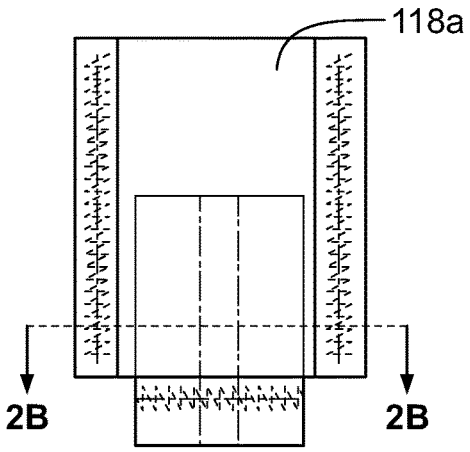
FIG. 2A shows a top view of an enlarged section of FIG. 1.
Figure 2B:
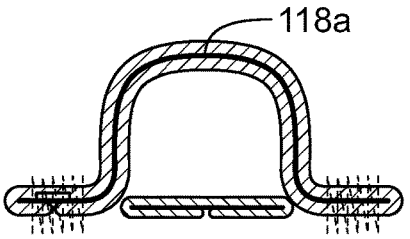
FIG. 2B shows a cross sectional view of FIG. 2A.
Figure 3:
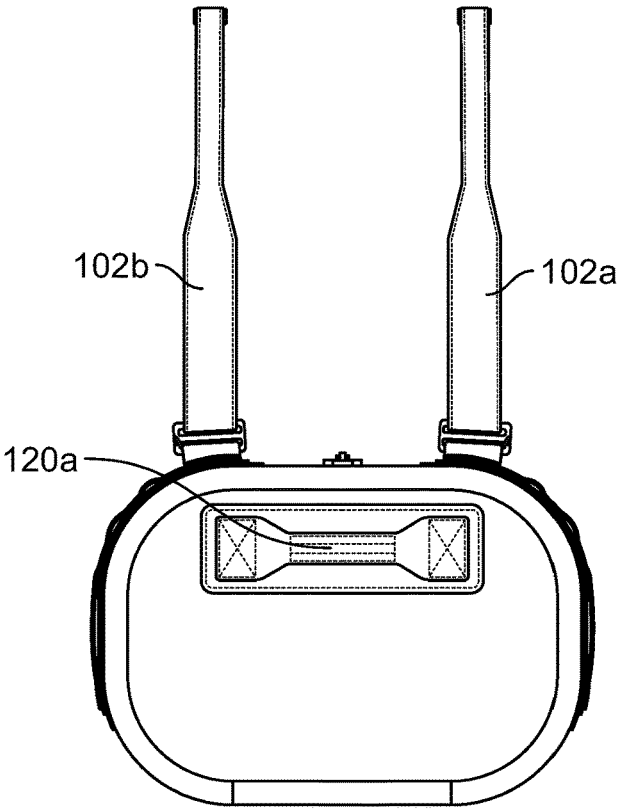
FIG. 3 shows a front view of the example bag of FIG. 1.
Figure 4:
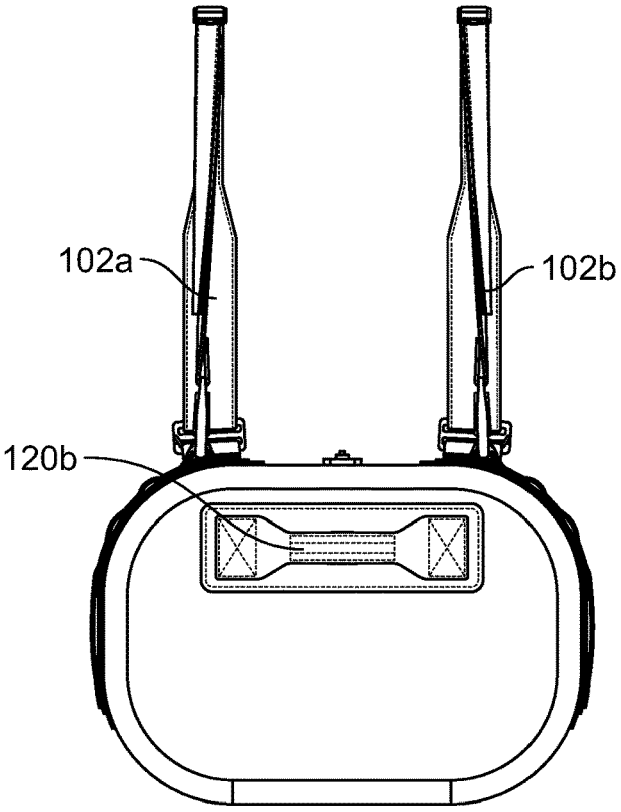
FIG. 4 shows a rear view of the example bag of FIG. 1.
Figure 5:
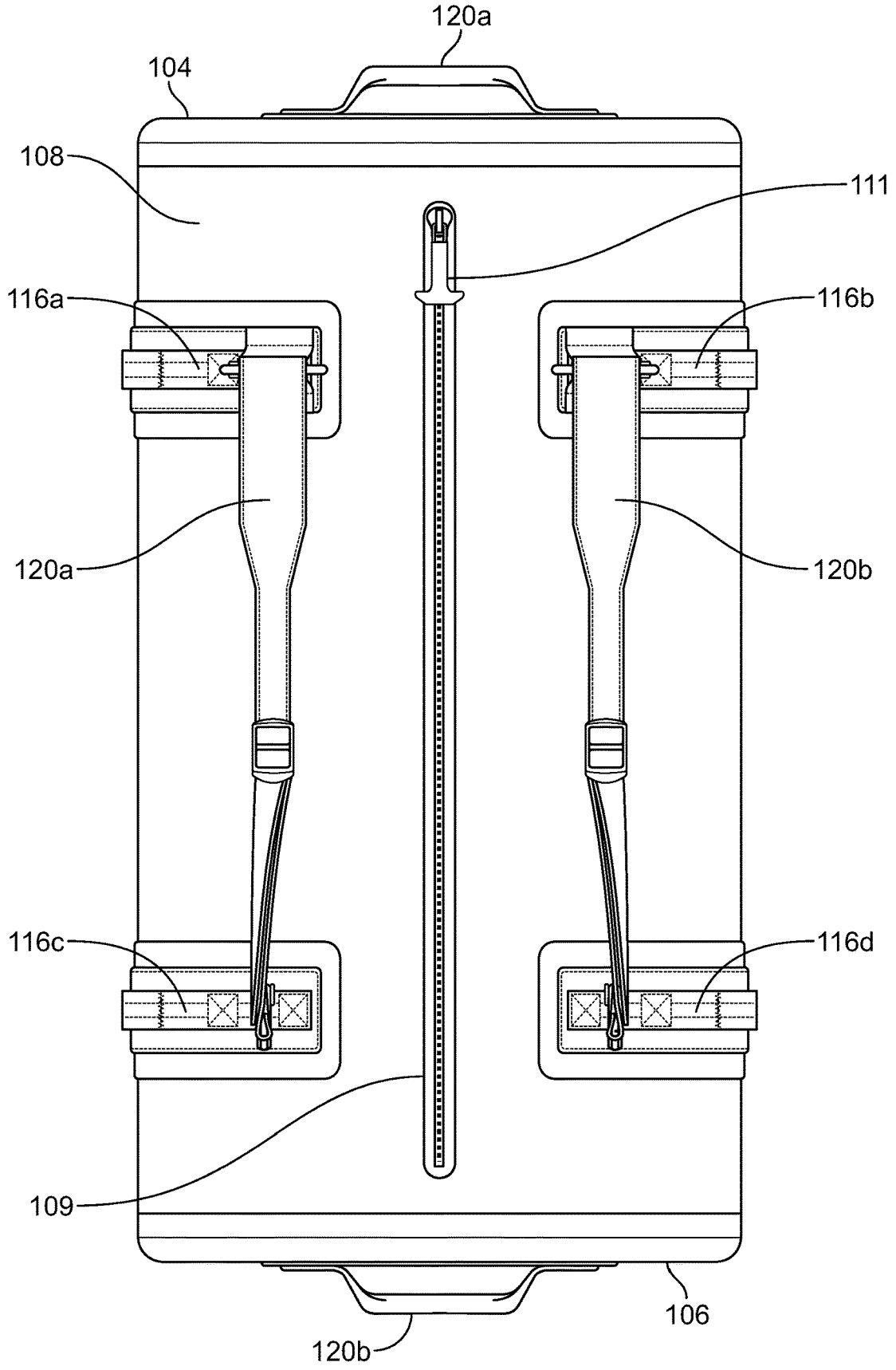
FIG. 5 shows a top view of the example bag of FIG. 1.

The bag can be provided with four sets of loops 116*a*, 116*b*, 116*c*, 116*d*, which can be configured to receive the adjustable carry straps 102*a*, 102*b* therein and various other items such as carabineers, drinkware, smaller bags, sleeping bags, pads, etc. It is contemplated that the loops 116*a*, 116*b*, 116*c*, 116*d* can be configured as attachment points, latch points, carrying loops, grab handles, or straps for grasping, holding, or hanging the bag. The loops 116*a*, 116*b*, 116*c*, 116*d* can be formed of different lengths and sizes to accommodate different functionality. Also, in certain alternative examples, the loops 116*a*, 116*b*, 116*c*, 116*d* can be configured as MOLLE loops or PALS webbing. The bag includes a first pair of upper loops 116*a*, 116*b*, and a second pair of lower loops 116*c*, 116*d*. In this example, the upper loops 116*a*, 116*b* can be formed identically to each other, and the lower loops 116*c*, 116*d* can be formed identically to each other. The upper loops 116*a*, 116*b* are similar to the lower loops 116*c*, 116*d*. However, in this example, the upper ring loops 118*a*, 118*b* are included adjacent to the upper loops 116*a*, 116*b*. The upper ring loops 118*a*, 118*b* are show in further detail in FIGS. 2A and 2B, where FIG. 2A is a top view of an example upper ring loop 118*a*, 118*b*, and FIG. 2B is a cross-sectional view of FIG. 2A along the line A-A. As depicted in FIGS. 2A and 2B, the upper ring loops 118*a*, 118*b* can be formed by stitching a piece of fabric into a U-shape on the bag 100.

As will be discussed below, the location of the upper loops 116*a*, 116*b* and the lower loops 116*c*, 116*d*, in one example, can be located such that the carry straps 102*a*, 102*b* can be adjusted to the desired use of the bag 100 as either a backpack or a hand carry bag. The loops 116*a*, 116*b*, 116*c*, and 116*d* can be arranged such that straps can serve as either backpack straps or hand carry straps, while providing comfortable carry options in each configuration. In this example, the loops 116*a*, 116*b*, 116*c*, 116*d* can be arranged such that they extend partially about an outer wall circumference of the bag. In this example, the first pair of upper loops 116*a*, 116*b* can be aligned in a first plane extending perpendicular to the axis of the bag, and the second pair of lower loops 116*c*, 116*d* can be aligned in a second plane extending perpendicular to the bag. Also the first plane and the second plane both plane can extend parallel to each other. Also the closure 109 may define a third plane which extends perpendicular to the first plane and the second plane formed by the loops 116*a*, 116*b*, 116*c*, 116*d*. The first pair of upper loops 116*a*, 116*b* can be positioned at a first axial distance and the second pair of lower loops 116*c*, 116*d* can be positioned at a second axial distance spaced from the upper loops 116*a*, 116*b*. In this way, the position of the lower loops 116*c*, 116*d* are arranged such that the straps 102*a*, 102*b* maintain the same axial position on the bag 100 regardless of which of the loops 116*c*, 116*d* the bottom portions 134 of the straps are located in.

In certain examples, the straps 102*a*, 102*b*, loops 116*a*, 116*b*, 116*c*, 116*d*, and handles 120*a*, 120*b* can be formed of nylon webbing. Other suitable materials may include polypropylene, neoprene, polyester, Dyneema, Kevlar, cotton fabric, leather, plastics, rubber, or rope. The straps 102*a*, 102*b*, loops 116*a*, 116*b*, 116*c*, 116*d*, and handles 120*a*, 120*b* can be attached to the outer shell of the bag 100 by stitching, adhesive, or polymer welding. It is also contemplated, as shown FIG. 1, that reinforcement patches 121 of material can be used in the areas where the straps 102*a*, 102*b*, loops 116*a*, 116*b*, 116*c*, 116*d*, and handles 120*a*, 120*b* are secured to the outer surface or shell of the bag 100 to make these areas of the bag 100 more robust to better support the weight of the bag in these areas. The hardware of the bag can be designed such that it can withstand many forces. In certain examples, the hardware can withstand 200 lbs. to 300 lbs. of force, and, in other examples, the hardware can be configured to withstand 500 lbs. to 1000 lbs. of force.

Figure 8:
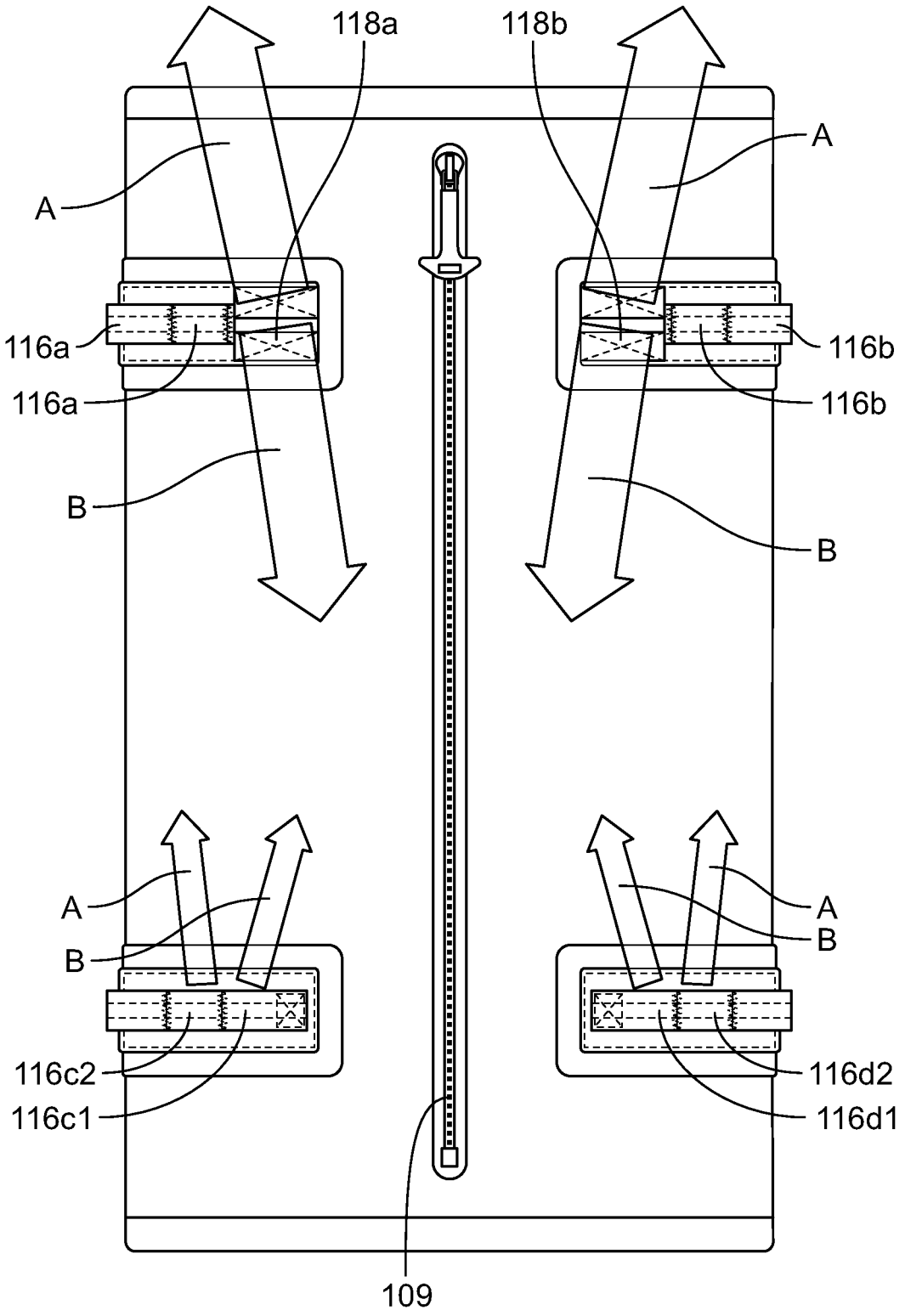
FIG. 8 shows a schematic illustrating example carry positions of the bag of FIG. 1.
Figure 8A:
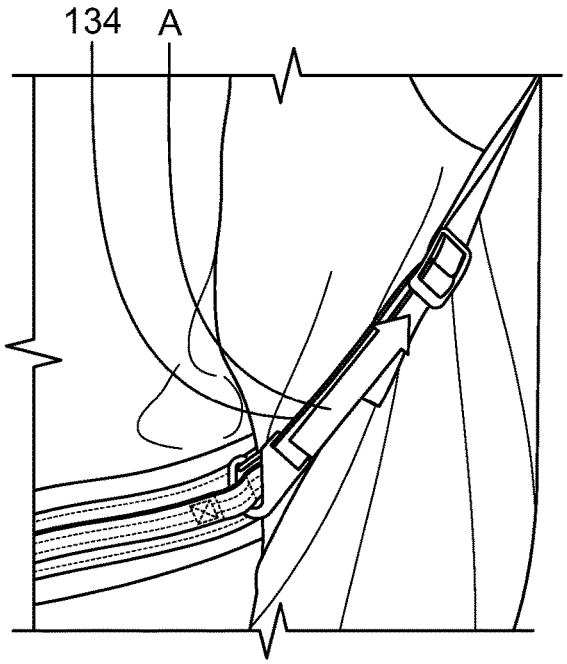
FIG. 8A shows a partial side and perspective view of the example bag of FIG. 1 in a backpack position.
Figure 8B:
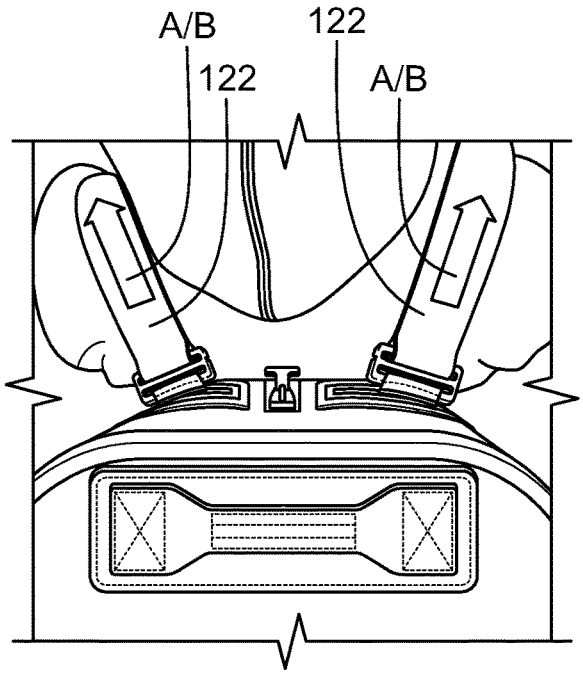
FIG. 8B shows a partial top and perspective view of the example bag of FIG. 1 also in the backpack position.
Figure 8C:
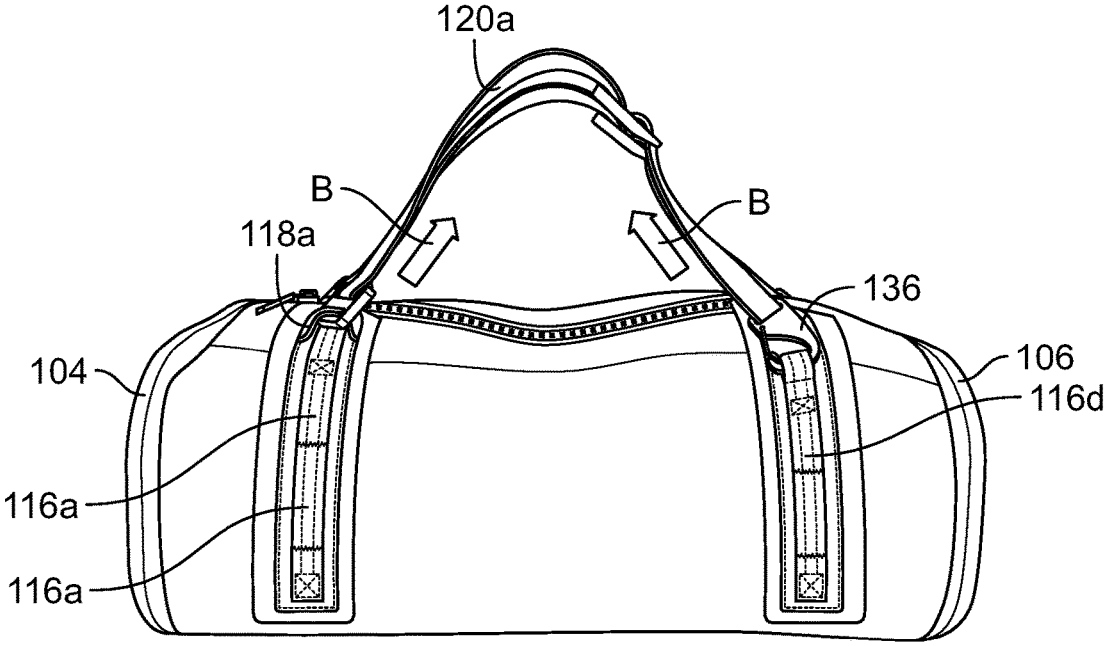
FIG. 8C shows a side perspective view of the bag in a hand carry position.

As illustrated in FIGS. 8-8C, the bag 100 can be configured to be carried in two positions, either on the shoulders of the user by or by the hands of the user. FIG. 8 illustrates the bag without the straps 102*a*, 102*b*, but illustrates the positions of the straps by way of arrows A and B to accommodate for different sized users. Also the straps can be located in either position to allow for the bag to be carried as either a backpack or as a hand bag. As shown in the schematic in FIG. 8, the carry straps 102*a*, 102*b* can be moved from a first backpack carrying arrangement location shown by arrows A to a second backpack carry arrangement shown by arrows B. In this example, the upper portions 122 of the straps remain fixed or located in the same position on the bag 100, but the bottom portions 134 of the straps can be moved from the first backpack carrying arrangement location shown by arrows A to the second backpack carrying arrangement shown by arrows B.

More specifically in order to arrange the bag in the first carrying arrangement or in the second carry arrangement, the straps 102*a*, 102*b* can be moved in the lower loops 116*c*, 116*d*. As shown in FIG. 8, the straps 102*a*, 102*b* at the bottom portions 134 in the first carrying position are moved circumferentially inward relative to the closure 109 of the of the bag 100 to the second carry position as indicated by the arrows B. Also the straps 102*a*, 102*b* can be moved circumferentially outward relative to the closure 109 of the bag from the second carrying position to achieve the first carrying position as indicated by the arrows A. Moreover, due to the oblong cross-sectional shape of the bag, the straps 102*a*, 102*b* at the bottom portions 134 in the backpack carrying position are moved radially inward relative to the axis of the of the bag 100 to the hand carry position as indicated by the arrows B. Also the straps 102*a*, 102*b* can be moved radially outward relative to the axis of the bag from the hand carrying position to achieve the backpack carrying position as indicated by the arrows A. As discussed in relation to the straps 102*a*, 102*b*, the bottom portions 134 can include a spring clip 136 so that the user can quickly and easily adjust the bottom portions 134 of the straps 102*a*, 102*b* into different positions for accommodating different users for utilizing the bag as a backpack.

During use, the user can move the adjustable straps 102*a*, 102*b* along the outer shell of the bag. The user can release the second ends 134 by releasing the spring clips 136 on the straps 102*a*, 102*b* from a first backpack carry position and securing the adjustable straps to a second backpack carry position. The user can move the adjustable straps 102*a*, 102*b* second ends of each straps 102*a*, 102*b* circumferentially along the bag to adjust the bag from the first backpack carry position to the second backpack carry position. The user does not have to move the upper or first ends 122 of the adjustable straps, and the upper or first ends 122 can remain fixed relative to the bag during adjustment of the second or lower ends 134 of the straps 102*a*, 102*b*. In one example, a first strap 102*a* of the pair of straps may be configured to move from a first loop 116*c*1 to a second loop 116*c*2 in a first lower set of loops 116*c*, and a second strap 102*b* of the pair of straps may be configured to move from a third loop 116*d*1 to a fourth loop 116*d*2 in a second lower set of loops 116*d*. The first loop 116*c*1 can be located at a first circumferential position, and the second loop 116*c*2 may be located at a second circumferential position. The third loop 116*d*1 may be located at third circumferential position, and the fourth loop 116*d*2 can be located at a fourth circumferential position. In one example, the first circumferential position may have the same spacing from the closure 109 as the third circumferential position and the second circumferential position may have the same spacing from the closure as the fourth circumferential position.

FIGS. 8A and 8B depict the bag in the backpack carrying position, where FIG. 8A shows a partial perspective side view of the bag 100 being carried on the back of a user, and FIG. 8B depicts a partial top view of the bag 100 being carried on the back of a user. The adjustment of the straps 102*a*, 102*b* circumferentially outward on the lower loops 116C, 116D allow the upper ends 122 of the straps 102*a*, 102*b* to be narrower at the user's shoulders relative to lower ends 134 of the straps 102*a*, 102*b* and thus relatively wider toward the user's lower back. This helps to accommodate for a better fit to the user during use of the bag 100 as a backpack. The weight of the bag can be positioned generally on the user's shoulders. Also the ability to adjust the ends of the straps 102*a*, 102*b* helps to distribute the weight of the bag to create a more stabilized bag 100 when the user carries the back on his or her shoulders, while also being adjustable to the particular user. Moreover, FIG. 8C depicts the straps 102*a*, 102*b* in the second carry position. In the second carry position, the straps 102*a*, 102*b* will have equal spacing at both the upper loops 116*a*, 116*b* and the lower loops 116*c*, 116*d*.

In addition to the carrying options discussed above, it is also contemplated that the straps may be used to tie down the bag on a roof rack, snowmobile, boat, bicycle, motorcycle, etc. by rearranging and tightening the straps within the loops. Moreover, the bag can be configured to have only one shoulders strap. For example, a single strap can be connected between upper ring loop 118*b* and first loop 116*c*1 of the first lower set of loops 116*c*.

In certain examples, the volume of the bag can be 50 liters, 75 liters, or 100 liters. Other bag sizes are also contemplated. The bag length can range from 50 cm to 100 cm, the bag width can range from 20 to 60 cm, the bag depth can range from 10 to 40 cm, the radius of the front and rear panels can be 7 to 12 cm. In one example, the 50 liter bag version can have a length of 60 cm, a width of 35 cm, a depth of 25 cm, the radius of the front and rear panel can be 9.2 cm. In one example, the 75 liter bag version can have a length of 71 cm, a width of 40 cm, a depth of 28 cm, the radius of the front and rear panel can be 10 cm. In one example, the 100 liter bag version can have a length of 83 cm, a width of 43 cm, a depth of 30 cm, the radius of the front and rear panel can be 10 cm. In certain examples, the length to width ratio can range from 1.5 to 3, the width to depth ratio can range from 1 to 2, and the depth to radius ratio can range from 1 to 3.5.

An example bag may include an outer shell, a front panel, a rear panel, a top sidewall, a bottom sidewall, a first sidewall, a second sidewall, and a closure configured to move from an open position to a closed position. The closure can extend along a length of the bag and can be located in the top sidewall. The bag may include a pair of adjustable straps each configured to releasably engage the bag at least at a one end. The adjustable straps may both include a first end and a second end. The adjustable straps may be configured to move from a first carry position to a second carry position by releasing the adjustable straps from the bag from the first carry position and securing the adjustable straps to the second carry position. The second end of each strap can be moved circumferentially along the bag to adjust the bag from the first carry position to the second carry position and each of the first ends of the adjustable straps can remain fixed relative to the bag during adjustment of each of the second ends of the straps. The first carry position and the second carry position may be both backpack carry positions and hand carry positions. Also the top sidewall may be configured to engage the back of a user during use as a backpack.

The bag may also include at least two sets of loops, and a first strap of the pair of adjustable straps can be configured to move from a first loop to a second loop in a first set of loops and a second strap of the pair of straps can be configured to move from a third loop to a fourth loop in a second set of loops. The first loop can be located at a first circumferential position and the second loop can be located at a second circumferential position, and the third loop can be located at third circumferential position and the fourth loop can be located at a fourth circumferential position. The first circumferential position can have the same spacing from the closure as the third circumferential position and the second circumferential position may have the same spacing from the closure as the fourth circumferential position. The bottom sidewall, the front panel, and the rear panel can be formed of a first material and the top sidewall, the first sidewall, and the second sidewall can be formed of a second material. The first material may be more rigid than the second material. In one example, the adjustable straps can maintain the same axial position from the first carry position to the second carry position. The bag may include four sets of loops, and two sets of loops may extend in a first plane and two sets may extend in a second plane. The first plane and the second plane may extend parallel to each other; the closure can define a third plane extending perpendicular to the first plane and the second plane.

In another example, a method can include forming a bag with an outer shell, and forming the bag with a front panel, a rear panel, a top sidewall, a bottom sidewall, a first sidewall, a second sidewall, and securing a closure configured to move from an open position to a closed position to the top sidewall, providing a pair of adjustable straps and configuring each of the adjustable straps to releasably engage the outer shell at least at one end and configuring the adjustable straps to move from a first carry position to a second carry position by configuring the adjustable straps to be releasable from the outer shell of the bag from the first carry position and configuring the adjustable straps to be secured to the second carry position and configuring adjustable straps such that they maintain the same axial position on the bag from the first carry position to the second carry position. The method may also include configuring the first carry position and the second carry position as both backpack carry positions and hand carry positions and configuring the top sidewall to engage the back of a user during use as a backpack. The method may also include providing the adjustable straps with a first end and a second end and configuring the second end of each adjustable strap to be moved circumferentially along the bag to adjust the bag from the first carry position to the second carry position and configuring each of the first ends of the adjustable straps to remain fixed relative to the bag during the adjustment of the straps from the first carry position to the second carry position. The method may also include providing the outer shell with at least two sets of loops and configuring a first strap of the pair of adjustable straps to move from a first loop to a second loop in a first set of loops and configuring a second strap of the pair of straps to move from a third loop to a fourth loop in a second set of loops. The method may also include locating the first loop at a first circumferential position and the second loop at a second circumferential position and locating the third loop at third circumferential position and the fourth loop at a fourth circumferential position and configuring the first circumferential position as having a same spacing from the closure as the third circumferential position and configuring the second circumferential position as having a same spacing from the closure as the fourth circumferential position. The method may also include forming the bottom sidewall, the front panel, and the rear panel of a first material and the top sidewall, the first sidewall, and the second sidewall of a second material, forming the first material more rigid than the second material, forming the outer shell of the bag with four sets of loops and arranging two sets of loops in a first plane and arranging two sets of loops in a second plane both extending parallel to each other and forming the closure in a third plane, the third plane extending perpendicular to the first plane and the second plane.

In another example, a bag may include an outer shell, a front panel, a rear panel, a top sidewall, a bottom sidewall, a first sidewall, a second sidewall, and a closure configured to move from an open position to a closed position, the closure extending along a length of the bag and being located in the top sidewall, a pair of adjustable straps, both including a first end and a second end and each configured to releasably engage the bag at least at one end and the adjustable straps being configured to move from a first carry position to a second carry position by releasing the adjustable straps from the bag from the first carry position and securing the adjustable straps to the second carry position. The second end of each strap can be moved circumferentially along the bag to adjust the bag from the first backpack carry position to the second hand carry position and each of the first end of the adjustable strap may remain fixed relative to the bag during adjustment of each of the second ends of the straps.

The outer shell further may include at least two sets of loops. A first strap of the pair of adjustable straps can be configured to move from a first loop to a second loop in a first set of loops, and a second strap of the pair of straps can be configured to move from a third loop to a fourth loop in a second set of loops. The first loop may be located at a first circumferential position and the second loop may be located at a second circumferential position and the third loop may be located at third circumferential position and the fourth loop may be located at a fourth circumferential position. The first circumferential position can have the same spacing from the closure as the third circumferential position and the second circumferential position may have the same spacing from the closure as the fourth circumferential position. The bag can generally represent a cuboid or rectangular prism with rounded corners.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A bag comprising:

a shell comprising a first panel, a second panel, a top wall, a bottom wall, a first sidewall, a second sidewall, and a closure configured to move from an open position to a closed position, the closure extending along a length of the bag and being located in the top wall;

a pocket positioned on the first sidewall;

a plurality of fabric loop sets wherein a first set of vertically stacked loops are positioned on an outer portion of the first sidewall and a second set of vertically stacked loops positioned on an outer portion of the second sidewall, and a third set of vertically stacked loops positioned on an outer portion of the first sidewall and a fourth set of vertically stacked loops positioned on an outer portion of the second sidewall, wherein the first, second, third, and fourth sets of vertically stacked loops are affixed to first, second, third, and fourth reinforcement patches, and wherein the first and third reinforcement patches are affixed to the first sidewall, wherein the second and fourth reinforcement patches are affixed to the second sidewall, wherein a horizontal distance between the first reinforcement patch and the third reinforcement patch forms a first width, wherein the pocket comprises a second width, and wherein the second width is less than the first width; and a pair of straps, wherein the straps comprise a first end and a second end, wherein the first end and the second end comprise a spring clip configured to removably engage the first, second, third, and fourth sets of vertically stacked loops, and wherein the straps extend along the length of the bag in an engaged configuration.

2. The bag of claim 1, wherein the pair of straps further include a strap adjuster configured to adjust a length of the straps.

3. The bag of claim 1, wherein the top wall is configured to engage the back of a user during use as a backpack.

4. The bag of claim 1, wherein the bottom wall is more rigid than the top wall.

5. The bag of claim 4, wherein the bottom wall and the top wall are formed of TPU nylon.

6. The bag of claim 5, wherein the bottom wall is secured to the top wall by polymer welding.

7. The bag of claim 1 further comprising at least one side handle.

8. The bag of claim 1, wherein the plurality of loop sets comprise webbing.

9. The bag of claim 1, wherein the shell is configured to form a water-resistant compartment for receiving contents in the bag.

10. The bag of claim 9, wherein the closure is a waterproof zipper assembly.

11. The bag of claim 10, wherein the closure forms a barrier to prevent liquid contents from either entering or exiting the bag.

12. The bag of claim 11, wherein the bag is configured to be submersible under water while keeping the contents in the bag dry.

13. A method comprising:

forming a bag with a shell, wherein the shell comprises a first panel, a second panel, a top wall, a bottom wall, a first sidewall, a second sidewall, and a closure on the top wall configured to move from an open position to a closed position, the closure extending along a length of the bag and being located in the top wall;

providing a pocket positioned on the first sidewall;

forming the shell of the bag with a plurality of fabric loop sets containing a series of loops and arranging a first set of loops on the first sidewall and the second sidewall and arranging a second set of loops on the first sidewall and the second sidewall;

forming the plurality of fabric loop sets wherein a first set of vertically stacked loops are positioned on an outer portion of the first sidewall and a second set of vertically stacked loops positioned on an outer portion of the second sidewall, a third set of vertically stacked loops positioned on an outer portion of the first sidewall and a fourth set of vertically stacked loops positioned on an outer portion of the second sidewall, wherein the first, second, third, and fourth sets of vertically stacked loops are affixed directly to first, second, third, and fourth reinforcement patches, and wherein the first and third reinforcement patches are affixed to the first sidewall and wherein the second and fourth reinforcement patches are affixed to the second sidewall, wherein a horizontal distance between the first reinforcement patch and the third reinforcement patch forms a first width, wherein the pocket comprises a second width, and wherein the second width is less than the first width; and providing a pair of straps, wherein the straps comprise a first end and a second end, wherein the first end and the second end comprise a spring clip configured to removably engage the first, second, third, and fourth sets of vertically stacked loops, and wherein the straps extend along the length of the bag in an engaged configuration, wherein the closure is positioned between the first handle and the second handle.

14. The method of claim 13, wherein the shell is configured to form a water-resistant compartment for receiving contents in the bag.

15. The method of claim 14, wherein the closure is a waterproof zipper assembly.

16. The method of claim 15, wherein the closure forms a barrier to prevent liquid contents from either entering or exiting the bag.

17. The method of claim 16, wherein the bag is configured to be submersible under water while keeping the contents in the bag dry.

18. A bag comprising:

a shell comprising a first panel, a second panel, a top wall, a bottom wall, a first sidewall, a second sidewall, and a zipper closure configured to move from an open position to a closed position, the closure extending along a length of the bag and being located in the top wall, wherein the closure forms a barrier to prevent contents from either entering or exiting the bag;

a pocket positioned on the first sidewall;

a plurality of fabric loop sets wherein a first set of vertically stacked loops are positioned on an outer portion of the first sidewall and a second set of vertically stacked loops positioned on an outer portion of the second sidewall, and a third set of vertically stacked loops positioned on an outer portion of the first sidewall and a fourth set of vertically stacked loops positioned on an outer portion of the second sidewall, wherein the first, second, third, and fourth sets of vertically stacked loops are affixed directly to first, second, third, and fourth reinforcement patches, and wherein the reinforcement patches are affixed to the first and second sidewalls, wherein a horizontal distance between the first reinforcement patch and the third reinforcement patch forms a first width, wherein the pocket comprises a second width, and wherein the second width is less than the first width; and a pair of straps, wherein the straps comprise a first end and a second end, wherein the first end and the second end comprise a spring clip configured to removably engage the first, second, third, and fourth sets of vertically stacked loops, wherein the straps extend along the length of the bag in an engaged configuration, and wherein the closure is positioned between a first handle and a second handle.

19. The bag of claim 18, wherein the closure forms a barrier to prevent liquid contents from entering the bag.

20. The bag of claim 18, wherein the bottom wall comprises a compression molded material, a foam structural layer, and an outer layer.

* * * * *